US005271554A

United States Patent [19]

Sauerwine

[11] Patent Number: 5,271,554

[45] Date of Patent: Dec. 21, 1993

[54] V-FOLD MAILER WITH RETURN ENVELOPE

[75] Inventor: Dean N. Sauerwine, Zionsville, Pa.

[73] Assignee: Moore Business Forms, Inc., Grand Island, N.Y.

[21] Appl. No.: 945,904

[22] Filed: Sep. 17, 1992

[51] Int. Cl.[5] ..... B65D 27/06

[52] U.S. Cl. ..... 229/303; 229/306; 229/314

[58] Field of Search ..... 229/72, 300, 301, 303, 229/306, 314, 316

[56] References Cited

U.S. PATENT DOCUMENTS

| | | | |
|---|---|---|---|
| 1,470,335 | 10/1923 | Sternheimer | 229/306 |
| 1,762,084 | 6/1930 | Snyder | 229/303 |
| 1,874,796 | 8/1932 | Palm | 229/303 |
| 3,227,360 | 1/1966 | Kreuger | 229/303 |
| 3,339,828 | 9/1967 | Hiersteiner | 229/72 |
| 3,618,284 | 11/1971 | Glendron | 53/23 |
| 4,148,430 | 4/1979 | Drake | 229/69 |
| 4,317,538 | 3/1982 | Alter et al. | 229/72 |
| 4,815,654 | 3/1989 | Buescher | 229/306 X |
| 4,852,795 | 8/1989 | Volk, Jr. | 229/301 X |

*Primary Examiner*—Allan N. Shoap

*Assistant Examiner*—Jes F. Pascua

*Attorney, Agent, or Firm*—Nixon & Vanderhye

[57] ABSTRACT

An intermediate for a mailer type business form, and the mailer itself, provide a secure construction of return envelope and may be manufactured in a simple manner from a single piece of paper. The mailer is formed by V-folding a single ply about a first fold line, with the left hand side of the outgoing mailer forming a return envelope and the right hand side forming detachable information containing panels. The outgoing address indicia is printed on the inner face of one of the panels forming the return envelope, while the other panel forming the return envelope has a window through which the outgoing address is visible. When the right hand portion of the mailer is detached, the panel of the right hand portion having reply address indicia printed on its inner face may be separated, by perforations, from the rest of the components and inserted into the return envelope to cover the outgoing address, and so that the reply address is clearly visible through the window of the return envelope. The glue strips holding the return envelope together also serve to hold the mailer in its outgoing configuration.

22 Claims, 3 Drawing Sheets

V-FOLD MAILER WITH RETURN ENVELOPE

BACKGROUND AND SUMMARY OF THE INVENTION

Mailers are popular type business forms. It is always desirable to be able to manufacture a mailer in as simple a manner as possible. It is also desirable to produce mailers having return envelopes as an integral part of the construction of an outgoing mailer, to insure proper return of coupons, or other components associated with the mailer, to the original sender.

According to the present invention, a mailer is constructed in a simple manner utilizing an intermediate made from a single ply of paper. The mailer according to the invention is constructed with a minimum number of processing steps, it being only necessary to run the web forming the intermediate in one pass through a press and one pass to have glue applied, the intermediate being folded along one edge in a V-fold, and then passing the mailer through a heat sealer or like device to activate the adhesive holding the mailer together. The mailer constructed according to the invention has a built-in return envelope which may be readily separated from the outgoing mailer, and the panels of the mailer not forming the return envelope may be easily detached and torn (along perforation lines) so that a coupon or card with reply address indicia printed on it may be inserted into the return envelope, with the reply address visible through a window in the return envelope.

According to one aspect of the present invention, a mailer intermediate is provided. The mailer intermediate comprises the following elements: A single ply having first and second faces. First and second orthogonal lines separating the ply into first, second, third an fourth panels, the second line being a line of weakness and the first line being a fold line; the first and fourth panels diagonally disposed with respect to each other, and the first and second panels separated by the first line and the first and third panels by the second line. Means defining a window in the second panel, and positioned a first distance from the first line. Outgoing address indicia printed on the second face of the first panel and positioned the first distance from the first line. Reply address indicia printed on the second face of one of the third and fourth panels. A return envelope flap exposing perforation formed in one of the first and second panels, and means defining a return envelope flap in the other of the first and second panels. First adhesive disposed on the second face of the return envelope flap. Two second permanent adhesive patterns disposed on the second face of at least one of the first and second panels for cooperating with the first line to define a return envelope if the ply is folded about the first line. And, third adhesive disposed on the second face of at least one of the third and fourth panels for holding the panels together if the ply is folded about the first line.

A mailer type business form is also constructed according to the present invention. The mailer type business form comprises the following elements: A single ply having first and second faces. First and second orthogonal lines separating the ply into first, second, third and fourth panels, the second line being a line of weakness and the first line being a fold line. The first and fourth panels diagonally disposed with respect to each other, and the first and second panels separated by the first line and the first and third panels by the second line, and the ply folded about the first line with the second faces of the first and second panels, and the third and fourth panels, respectively, in face to face contact with each other. Means defining a window in the second panel, and positioned a first distance from the first line. Outgoing address indicia printed on the second face of the first panel and positioned the first distance from the first line, and viewable through the window from exterior of the first face of the first panel. Reply address indicia printed on the second face one of the third and fourth panels and dimensioned so as to fit within the window if inserted into operative association therewith. A return envelope flap exposing perforation formed in one of the first and second panels, and means defining a return envelope flap in the other of the first and second panels. First adhesive disposed on the second face of the return envelope flap. Two second permanent adhesive patterns disposed on the second face of at least one of the first and second panels for cooperating with the first line to define a return envelope. And third adhesive disposed on the second face of at least one of the third and fourth panels for holding the panels together in an outgoing configuration of the mailer.

In the mailer according to the invention, the two second permanent adhesive patterns are preferably disposed adjacent the second line, and parallel to the second line on the edge of the first and second panels opposite the second line, with the return envelope open at the top. The reply address indicia is printed on the third panel, and by tearing along perforation lines in the third panel, a coupon can be separated from the third panel that fits in the return envelope without folding. When the coupon is inserted in the return envelope, the reply address is visible through the window in the second panel. The first adhesive preferably comprises rewettable adhesive, while the second and third adhesive comprises a permanent heat seal or pressure seal adhesive.

According to yet another aspect of the present invention, a mailer type business form comprising a double thickness left hand portion and a double thickness right hand portion, separated by a first perforation line, is provided. The left hand portion comprises: A first panel having an inner face with outgoing address indicia printed thereon, and an outer face forming the back of the mailer; a second panel having means defining a window therein through which the outgoing address indicia is visible, an inner face, and an outer face forming the front of the mailer; a return envelope formed in one of the first and second panels, with first adhesive on the inner face thereof; and, second adhesive connecting the inner faces of the first and second panels together to form a return envelope. The right hand portion comprises: A third panel having an inner face with reply address indicia printed thereon, and an outer face forming the back of the mailer in an outgoing configuration; and a fourth panel having an inner face in face-to-face contact with the inner face of the third panel, and an outer face forming the front of the mailer in an outgoing configuration, the outer face having postal indicia printed thereon. There is also provided: Third adhesive for holding the panels together in an outgoing configuration of the mailer, but when removed, and when the mailer is separated along the first perforation line, allowing access to the reply address containing inner face of the third panel; and, second perforation means formed in the third panel for allowing easy tearing of the third panel into a configuration that will fit within the return envelope without folding, and with the reply address indicia clearly visible through the window in the second panel.

The postal indicia printed on the outer face of the fourth panel preferably includes outgoing addressee bar coding. The particular adhesives, positioning of the components, and the like are preferably as described with respect to the mailer in the preceding paragraphs.

It is the primary object of the present invention to provide an advantageous mailer intermediate, and mailer type business form, including a return envelope. This and other objects of the invention will become clear from an inspection of the detailed description of the invention, and from the appended claims.

DETAILED DESCRIPTION OF THE DRAWINGS

Figure 1:
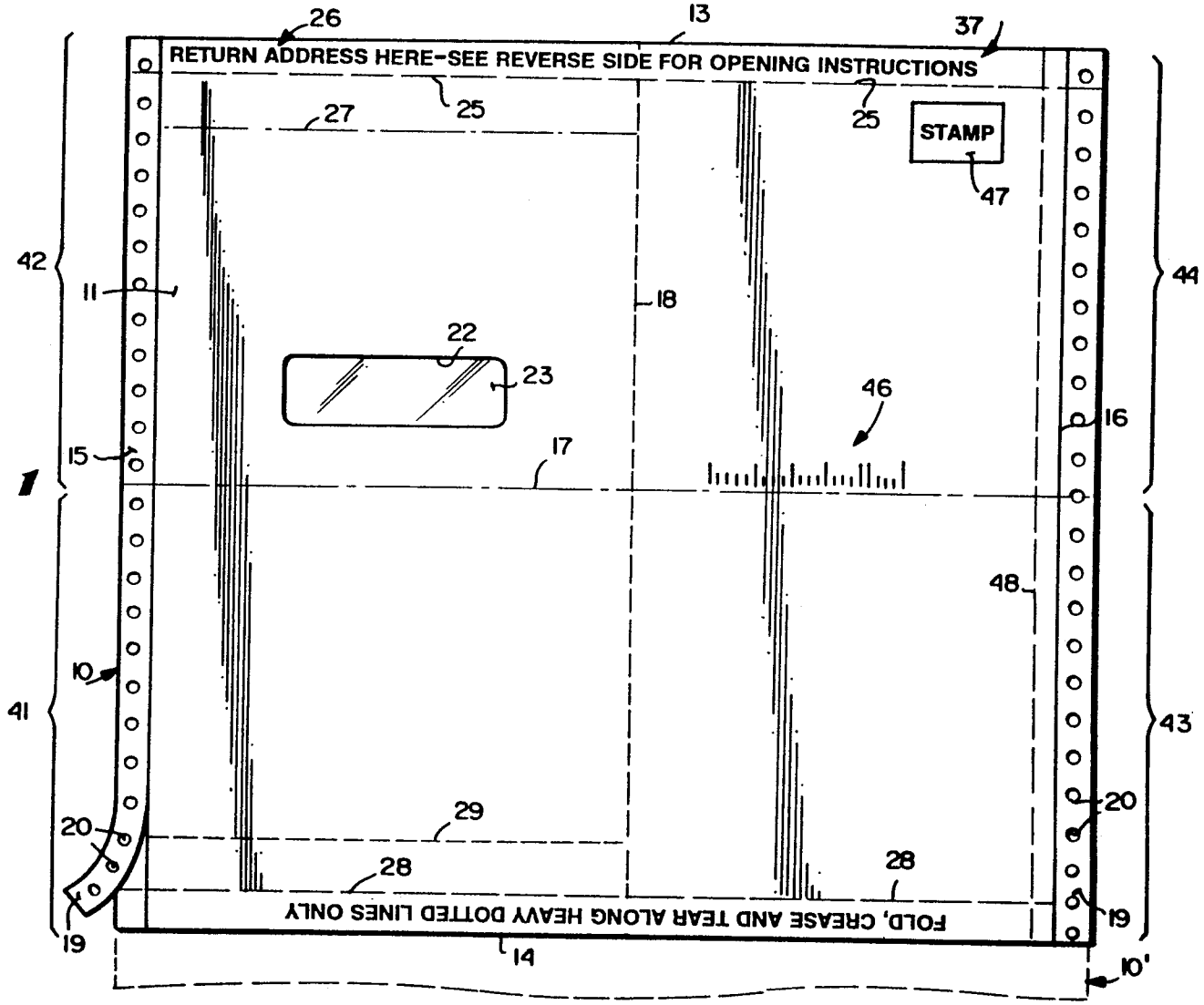
FIG. 1 is a top plan view of a first face of a mailer intermediate according to the invention.
Figure 2:
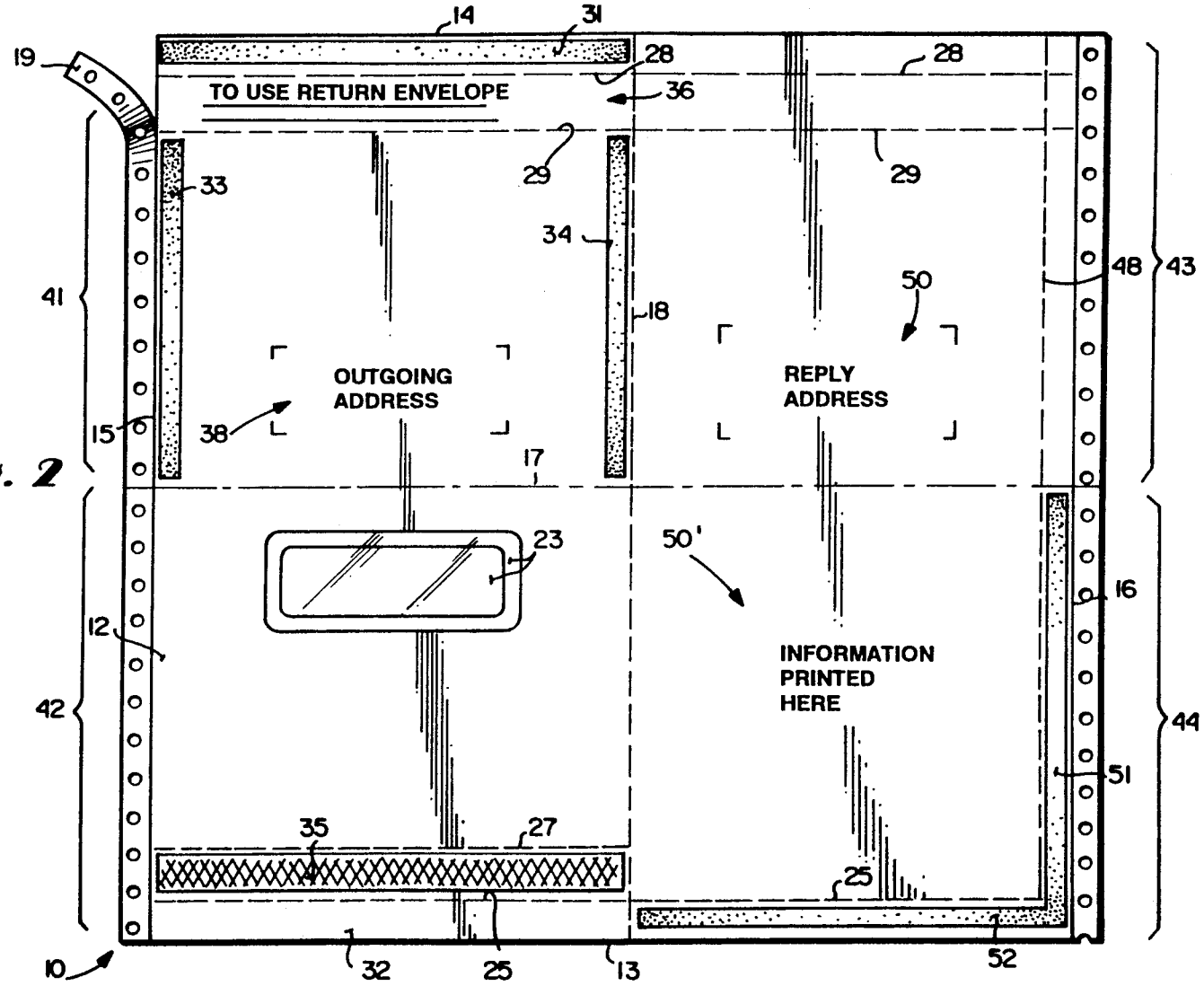
FIG. 2 is a top plan view of the second face of the intermediate of FIG. 1.

A mailer intermediate according to the invention is illustrated generally by reference numeral 10 in FIGS. 1 and 2. It comprises a single paper ply which includes a first face 11 (FIG. 1), which forms the outer face of a mailer, and a second, inner face 12 (FIG. 2). The mailer intermediate 10 has a generally quadrate configuration and has "top" and "bottom" edges 13, 14, and side edges 15, 16. The intermediate 10 is originally produced in continuous configuration, other like mailers being disposed in continuous form along the edges 13, 14 thereof (which edges are defined by perforation lines in the continuous format), a like mailer intermediate, in the continuous format, being illustrated at 10' in FIG. 1.

The intermediate 10 also comprises a first line 17 which is parallel to the edges 13, 14 and essentially intermediate those edges, and a second line 18, which is parallel to and generally intermediate the edges 15, 16. The line 17 preferably is a fold line (crease) while the line 18 preferably is a line of weakness, such as a perforation. In the continuous format, the intermediate 10 also includes border strips 19 which have tractor drive holes 20 therein; however, the border strips 19 are cut off, using a slitter, prior to forming the intermediate into a mailer, the left hand border portion 19 being shown at the start of the removal process in FIGS. 1 and 2.

The intermediate 10 also includes means defining a window 22 therein, through which address indicia is ultimately read in the mailer constructed from the intermediate 10. Preferably the window 22 is covered by a transparent patch 23, which (as seen in FIG. 2) may be glued to the inner face 12 of the single ply of paper forming the intermediate 10. The intermediate 10 also may include perforation line 25 adjacent the edge 13 and parallel to the first line 17, and return address indicia 26 may be printed between the perf line 25 and the edge 13. Another line 27, which may be a perf line or fold line, can be provided which ultimately defines a flap in a return envelope. A perf line 28 is formed adjacent and parallel to the edge 14, being spaced therefrom the same distance that the perf line 25 is from the edge 13, and a perf line 29 is disposed adjacent the perf line 28, forming a stub that is removed to expose adhesive on the return envelope flap, as will be hereinafter described.

A permanent adhesive strip, such as heat sealable adhesive, 31 may be provided between the perf line 28 and the edge 14 on the second face 12, as illustrated in FIG. 2, which cooperates with the stub portion 32 between the perf line 25 and edge 13 to hold an outgoing mailer constructed from the intermediate 10 in outgoing configuration. Also, adhesive patterns, such as strips, 33, 34 are provided on the second face 12, as seen in FIG. 2. The strip 33 is adjacent and parallel to the edge 15, while the strip 34 is adjacent and parallel to the second line 18. The strips 33, 34 are preferably of the same type of permanent adhesive as the strip 31, e.g., heat seal adhesive, or pressure activated adhesive (e.g., cohesive).

Another strip of adhesive, 35 (see FIG. 2), is disposed on what ultimately will become the flap of the return envelope, that strip 35 in the outgoing configuration of the mailer formed from the intermediate 10 being covered by the removable stub 36. Indicia 37 (see FIG. 1) provide instructions to the recipient of the mailer constructed from the intermediate 10 telling the recipient how to open the mailer.

The orthogonal lines 17, 18 define the ply forming intermediate 10 into four panels, a first panel 41, a second panel 42, a third panel 43, and a fourth panel 44 (see FIGS. 1 and 2). The window 22 is formed in the second panel 42, while outgoing address indicia 38 is printed on the second face 12 of the first panel 41 (see FIG. 2). On the first face 11 of the fourth panel 44, postal indicia is printed, such as the outgoing addressee bar coding 46, and the indicia 47 indicating where postage should be placed, or a permit number, or the postage itself. A perforation line 48 is provided adjacent the edge 16 and parallel to it.

In order to form a mailer 49 (see FIG. 3) from the intermediate 10, the paper sheet forming the intermediate 10 is merely V-folded about the first fold line 17. When this is done, the outgoing address 38 is visible through the window 22. The second faces 12 of the panels 41, 42 and 43, 44, respectively, are brought into contact with each other, while the first faces 11 of the panels 42, 44 form the outer front of the mailer 49, and the faces 11 of the first and third panels 41, 43 form the back outer face of the mailer 49.

Also according to the invention, reply address indicia 50 is printed on the second face 12 of the third panel 43, as illustrated in FIG. 2, while information indicia—intended to transmit information to the recipient of the mailer 49—is printed at least on the inner face 12 of the fourth panel 44 (see 50' in FIG. 2), and possibly also on the inner face 12 of the third panel 43 remote from the reply address indicia 50.

In order to hold the right hand portion of the mailer 49 together in an outgoing configuration (FIG. 3), the adhesive strips 51, 52 (see FIG. 2) are also provided. Strip 51 is disposed between the edge 16 and the perforation 48 on either one or both of the third and fourth panels 43, 44, while the strip 52 is disposed between the edge 13 and the perforation 25 (and/or between the edge 14 and perforation 28). The adhesive forming the strips 51, 52 is of the same type that the adhesive strips 31, 33, 34, e.g., heat seal adhesive.

In the manufacture of the mailer 49, a web of paper which will form the intermediate 10 is passed through a press where the indicia 37, 47, 50, and 50' is printed. It is also passed through a machine where the adhesive strips are applied, particularly the strips 31, 33, 34, 35, 51, and 52. Then after the individual intermediates are burst from the continuous form, they are V-folded about the first line 17, and then passed through a sealer, e.g., a heat sealer or pressure sealer, which activates the adhesive strips 31, 33, 34, 51, and 52, thereby sealing the mailer 49 in its outgoing configuration.

Figure 3:
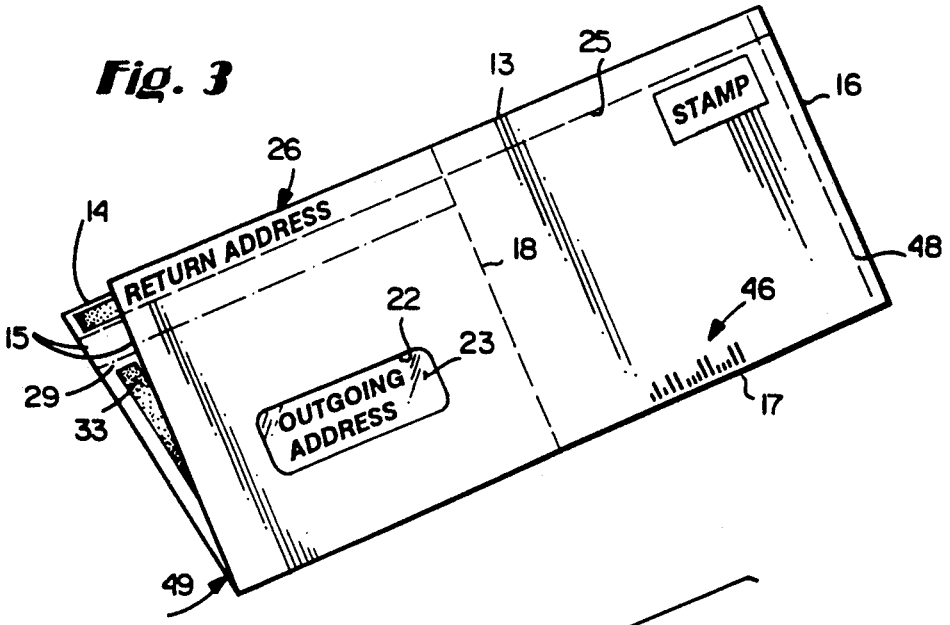
FIG. 3 is a top perspective view of the intermediate of FIGS. 1 and 2 being folded into the configuration of a mailer type business form according to the invention.
Figure 4:
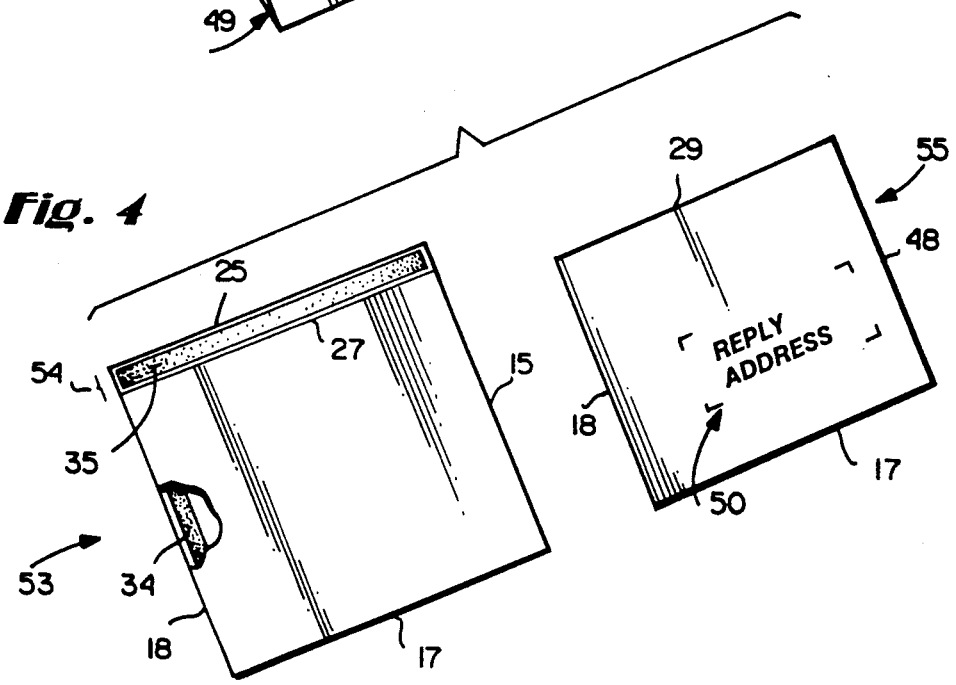
FIG. 4 is a bottom perspective view of the return envelope separated from the mailer of FIG. 3, and a top perspective view of a return coupon separated from the mailer of FIG. 3.

When the recipient receives the mailer 49, he/she tears along the perforations 25, 28, 48 and 18, thereby separating the left hand portion of the mailer 49 in FIG. 3 from the right hand portion. The right hand portion also can be severed by tearing along the fold (or perforation) line 17. The stub 36 is also removed by tearing along the perforation line 29. This results in the production of a return envelope 53 and the return coupon 55 (see FIG. 4).

Figure 5:
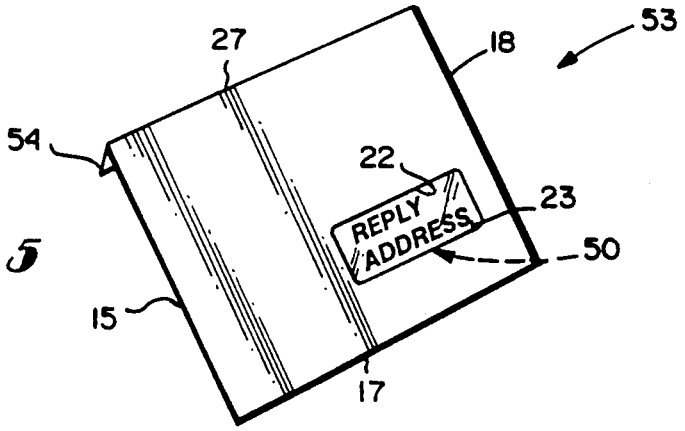
FIG. 5 is a top perspective view of the return envelope of FIG. 4 with the coupon of FIG. 4 inserted therein.

The return envelope 53 has a flap 54, which is defined by the perf line (subsequently edge) 25, and the perf or fold line 27. The coupon 55 has the reply address indicia 50 printed thereon, and is dimensioned so that it will fit within the return envelope 53 without bending or folding, and is so dimensioned (and the reply address indicia is so positioned) that the reply address indicia 50 is visible through the window 22 once the coupon 55 is inserted in the envelope 53—as seen in FIG. 5. After the coupon 55 is inserted through the open end of the return envelope 53 (adjacent the flap 54 and remote from the edge/line 17), the flap 54 is pivoted about fold line or perforation 27, the rewettable adhesive 35 is wet, and the flap 54 is sealed to form a closed return envelope 53.

It will thus be seen that according to the present invention an advantageous mailer, with return envelope, is produced in a simple and effective manner. The mailer also has a minimum amount of adhesive since the adhesive strips 33, 34 serve the dual function of holding both the return envelope and the outgoing mailer together, and since one closed edge of the return envelope 53 is formed by the fold line 17.

While the the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A mailer intermediate comprising:

a single ply having first and second faces;

first and second orthogonal lines separating said ply into first, second, third an fourth panels, said second line being a line of weakness and said first line being a fold line; said first and fourth panels diagonally disposed with respect to each other, and said first and second panels separated by said first line and said first and third panels by said second line;

means defining a window in said second panel, and positioned a first distance from said first line;

outgoing address indicia printed on said second face of said first panel and positioned said first distance from said first line;

reply address indicia printed on said second face of one of said third and fourth panels;

a return envelope flap exposing perforation formed in one of said first and second panels, and means defining a return envelope flap in the other of said first and second panels;

first adhesive disposed on said second face of said return envelope flap;

two second permanent adhesive patterns disposed on said second face of at least one of said first and second panels for cooperating with said first line to define a return envelope when said ply is folded about said first line; and third adhesive disposed on said second face of at least one of said third and fourth panels for holding said panels together when said ply is folded about said first line.

2. An intermediate as recited in claim 1 wherein said two second permanent patterns are disposed adjacent edges of one of said first and second panels, and extend substantially perpendicular to said first line.

3. An intermediate as recited in claim 2 wherein said second permanent adhesive patterns are disposed on said first panel inner face.

4. An intermediate as recited in claim 3 wherein said second permanent adhesive patterns and said third adhesive are selected from the group consisting essentially of heat seal adhesive and pressure seal cohesive.

5. An intermediate as recited in claim 3 wherein said return envelope flap is formed in said second panel, adjacent an edge thereof most remote from said first line, and extending parallel to said first line.

6. An intermediate as recited in claim 5 wherein said first adhesive is rewettable adhesive.

7. An intermediate as recited in claim 1 further comprising postal indicia printed on said first face of said fourth panel.

8. An intermediate as recited in claim 1 wherein said third adhesive is disposed adjacent one edge of said fourth panel, extending transverse to said first line, and along another edge of said fourth panel most remote from said first line; and further comprising perforation means disposed adjacent said third adhesive to allow ready detachment of portions of said panels sealed together by said third adhesive by tearing along said perforation means.

9. An intermediate as recited in claim 8 wherein said third adhesive further comprises an adhesive strip formed from said first fold line and parallel to said first fold line; and additional perforation means disposed adjacent said strip formed on said first panel inner face.

10. A mailer type business form, comprising:

a single ply having first and second faces;

first and second orthogonal lines separating said ply into first, second, third and fourth panels, aid second line being a line of weakness and said first line being a fold line; said first and fourth panels diagonally disposed with respect to each other, and said first and second panels separated by said first line and said first and third panels by said second line, and said ply folded about said first line with said second faces of said first and second panels, and said third and fourth panels, respectively, in face to face contact with each other;

means defining a window in said second panel, and positioned a first distance from said first line;

outgoing address indicia printed on said second face of said first panel and positioned said first distance from said first line, and viewable through said window from exterior of said first face of said first panel;

a return envelope flap exposing perforation formed in one of said first and second panels, and means defining a return envelope flap in the other of said first and second panels;

first adhesive disposed on said second face of said return envelope flap;

two second permanent adhesive patterns disposed on said second face of at least one of said first and second panels for cooperating with said first line to define a return envelope;

reply address indicia printed on said second face of one of said third and fourth panels and dimensioned so as to fit within said window when inserted into the return envelope; and third adhesive disposed on said second face of at least one of said third and fourth panels for holding said panels together in an outgoing configuration of said mailer.

11. A mailer as recited in claim 10 wherein said two second permanent patterns are disposed adjacent edges of one of said first and second plies, and extend substantially perpendicular to said first line.

12. A mailer as recited in claim 11 wherein said second permanent adhesive patterns are disposed on said first panel inner face.

13. A mailer as recited in claim 12 wherein said second permanent adhesive patterns and said third adhesive are selected form the group consisting essentially of heat seal adhesive and pressure seal cohesive.

14. A mailer as recited in claim 10 further comprising postal indicia printed on said first face of said fourth panel.

15. A mailer as recited in claim 10 wherein said third adhesive is disposed adjacent one edge of said fourth panel, extending transverse to said first line, and along another edge of said fourth panel most remote from said first line; and further comprising perforation means disposed adjacent said third adhesive to allow ready detachment of portions of said panels sealed together by said third adhesive by tearing along said perforations.

16. A mailer as recited in claim 15 wherein said third adhesive further comprises an adhesive strip formed on said first panel adjacent an edge thereof most remote from said first fold line parallel to said first fold line; and additional perforation means disposed adjacent said strip formed on said first panel inner face.

17. A mailer as recited in claim 10 wherein said reply address indicia is printed on said second face of said third panel; and further comprising perforation means formed on said third panel for allowing easy tearing of said third panel into a coupon having a size that fits in said return envelope without bending, with said reply address indicia readily visible through said window in said second panel.

18. A mailer type business form comprising a double thickness left hand portion, and a double thickness right hand portion, separated by a first perforation line;

said left hand portion comprising: a first panel having an inner face with outgoing address indicia printed thereon, and an outer face forming the back of said mailer; a second panel having means defining a window therein through which said outgoing address indicia is visible, an inner face, and an outer face forming the front of said mailer; a return envelope flap formed in one of said first and second panels, with first adhesive on the inner face thereof; and second adhesive connecting said inner faces of said first and second panels together to form a return envelope;

said right hand portion comprising: a third panel having an inner face with reply address indicia printed thereon, and an outer face forming the back of said mailer in a an outgoing configuration; and a fourth panel having an inner face in face-to-face contact with said inner face of said third panel, and an outer face forming the front of said mailer in an outgoing configuration, said outer face having postal indicia printed thereon;

third adhesive for holding said panels together in an outgoing configuration of said mailer, but when removed, and when said mailer is separated along said first perforation line, allowing access to sad reply address containing inner face of said third panel; and second perforation means formed in said third panel for allowing easy tearing of said third panel into a configuration that will fit within said return envelope without folding, and with said reply address indicia clearly visible through said window in said second panel.

19. A mailer as recited in claim 18 wherein said postal indicia printed on said outer face of said fourth panel comprises outgoing addressee bar coding.

20. A mailer as recited in claim 18 wherein said second adhesive comprises a pair of permanent adhesive strips disposed parallel to said first perforation line, one adjacent said first perforation line, and the other adjacent the side edges of said first and second panels most remote from said first perforation line.

21. A mailer as recited in claim 20 wherein said third adhesive further comprises a strip of adhesive adjacent said return envelope flap and extending parallel thereto; and a third perforation means extending parallel to said strip between said strip and said flap.

22. A mailer as recited in claim 21 wherein said third adhesive further comprises adhesive strips connecting said third and fourth panels together along edges thereof, and fourth perforation means, cooperating with the second perforation means to allow detachment of portions of said third and fourth panels held together by said adhesive strips.

* * * * *